United States Patent [19]

Cooke

[11] Patent Number: 4,612,879

[45] Date of Patent: Sep. 23, 1986

[54] HOT WATER HEATER AND STEAM GENERATOR

[75] Inventor: George Cooke, Toronto, Canada

[73] Assignee: Elizabeth E. Cooke, Toronto, Canada

[21] Appl. No.: 739,403

[22] Filed: May 30, 1985

[51] Int. Cl.[4] ..... F22B 21/08

[52] U.S. Cl. ..... 122/235 F; 122/135 F; 122/155 A; 122/155 F; 122/172; 122/177; 122/182 S; 122/480

[58] Field of Search ..... 122/135 F, 155 R, 155 A, 122/155 F, 156, 166 R, 166 A, 167, 169, 170, 172, 176, 177, 182 R, 182 S, 235 R, 235 F, 480; 126/360 R, 360 A

[56] References Cited

U.S. PATENT DOCUMENTS

| | | | |
|---|---|---|---|
| 2,077,323 | 4/1937 | Hendrix | 122/156 |
| 3,007,457 | 11/1961 | Ospelt | 122/155 R |
| 3,518,973 | 7/1970 | Herzenberg | 122/235 R |
| 3,696,794 | 10/1972 | Kearns | 122/235 R |
| 3,791,351 | 2/1974 | Kent | 122/480 X |
| 4,355,602 | 10/1982 | Cooke | 122/135 F X |
| 4,488,514 | 12/1984 | de Poray et al. | 122/182 R X |

*Primary Examiner*—Albert J. Makay
*Assistant Examiner*—Steven E. Warner
*Attorney, Agent, or Firm*—Sprung Horn Kramer & Woods

[57] ABSTRACT

In a water tube boiler comprising a housing enclosing tubes bent to form vertical chambers successively traversed by rising hot combustion gases, the tubes being connected at the bottom to the interior of the jacket of a jacketed cylindrical combustion chamber, which jacket is supplied with cold water, and at the top to a steam manifold, the manifold and jacketed chamber project beyond the housing with a downcomer outside the housing connecting the top of the jacket and the lowest part of the manifold, thereby permitting the boiler to operate with a shallow level of water in the manifold, speeding up circulation of water and its heating, and permitting substantially dry steam to be discharged from the upper manifold. The chambers may include baffles which are angled so that the hot gas hits them at an angle less than 90° so as to be deflected thereby in the direction of its advance, thereby avoiding hot spots. Advantageously successive chambers from bottom to top are reduced in volume to make up for the reduction in volume as the hot gas cools, thereby keeping the gas velocity high and maintaining turbulence which helps heat exchange. A gas or oil burner is situated so that its flame is within the water-cooled jacketed chamber. Alternatively, instead of burning fuel within the chamber, the chamber can be supplied with waste heat as from a turbine exhaust.

12 Claims, 5 Drawing Figures

HOT WATER HEATER AND STEAM GENERATOR

This application relates to an improvement in water tube boilers wherein the water tubes are in two sets, each bent in such a way as to provide a plurality of superposed gas chambers through which combustion gases successively flow in upward direction.

In U.S. Pat. No. 4,355,602 there is described a simple boiler of the abovementioned type which is relatively simple and inexpensive to manufacture and operate. That boiler comprises a housing having a top provided with a gas outlet, bottom, left and right sides and a front and back, the housing containing an upper manifold and a lower manifold substantially parallel to the top, bottom and side walls, two sets of tubes, each set comprising a plurality of tubes, one set joining the upper manifold to the lower manifold on the left and the other set joining the upper manifold to the lower manifold on the right, the tubes of each set rising from the lower manifold upwardly along their respective side wall, crossing the housing to the opposite side wall, rising adjacent the opposite side wall, re-crossing the housing to their respective side wall, rising therealong and eventually joining the upper manifold, the horizontal runs of the tubes of one set being vertically offset relative to the horizontal runs of the tubes of the other set so as to form a plurality of superposed chambers, individual tubes of the sets being differently bent so as to form access openings from each chamber to the chambers above and below, the openings from chamber to chamber being offset so as to require a gas flowing through said chambers to traverse one chamber from front to back and the next chamber from back to front, means for introducing water into the lower manifold and for withdrawing water and/or steam from the upper manifold, and means for introducing a hot gas into the lowermost of the superposed chambers, the hot gas rising successively through the chambers which it successively and alternately traverses from front to back and then from back to front until it exits from the uppermost chamber through the gas outlet in the top, water flowing through the manifolds and tubes being heated by the hot gas. Preferably there is provided at least one baffle within at least one of the chambers extending from top to bottom and from one of the sides toward but terminating short of the other, whereby hot gas traversing that chamber from front to back is additionally forced to flow laterally to get around said baffle.

It is an object of the present invention to improve the efficiency of operation of such a boiler by simple structural modifications.

These and other objects and advantages are realized in accordance with the present invention pursuant to which the lower manifold is replaced by a jacketed chamber. The tubes are connected to the exterior of the jacket so that liquid can pass between the insides of the tube and jacket. The jacketed chamber serves as the combustion chamber for a fuel burner or as the entrance for hot gases generated from an external source, e.g., a gas turbine.

Adjacent the end of the jacketed chamber one or more openings are provided to permit the flow of the hot gases from the jacketed chamber to the first gas flow chamber thereabove. The opening(s) may be of variable effective cross-section to permit adjustment of the back pressure at the entrance to the jacketed chamber. Such variability can be achieved by adjustable butterfly dampers, or the like.

Because the combustion chamber is water-cooled it suffices to make it of unlined metal, whereas such chambers normally require refractory insulation. This eliminates expensive refractories and the bulk and weight they add to the system as the housing would otherwise require.

The water-containing tubes are never exposed to the combustion flame which is contained within the jacketed chamber. This absence of radiant heat on the tubes and their welded joints reduces the stress on the system, thereby prolonging its life.

The number of chambers traversed by gas above the combustion chamber may be as little as four but six or eight are preferred, successive chambers of the boiler preferably being reduced in volume from bottom to top to make up for the reduction in volume as the hot gas cools, thereby keeping the gas velocity high and maintaining turbulence which helps heat exchange.

Advantageously the manifold projects outside the housing along with the jacketed chamber and a downcomer outside the housing connects the lowest part of the manifold with the outside of the jacket, thereby permitting the boiler to operate with a shallow level of water in the upper manifold, speeding up circulation of water and its heating, and permitting substantially dry steam to be discharged from the upper manifold.

In accordance with another aspect of the invention a baffle (or baffles) may be positioned within one or more of the chambers so that the hot gas must traverse a serpentine path within such chamber. Advantageously the baffle is angled and the gas hits it at an angle less than 90° so as to be deflected thereby in the direction of its advance, thereby avoiding hot spots.

The novel boiler performs especially well with a fuel burner of special construction, such as that sold by Esso Petroleum Canada under the designation Mectron 3M Type 214T. Such burner communicates with the jacketed chamber, for the most part being outside the boiler housing. It is oil-fired and includes a nozzle feeding gas past a venturi throat where it burns almost completely. The venturi is designed to permit recirculation of the gas past the nozzle to ensure complete combustion. A gas-fired burner may also be used to generate the gas in the jacketed chamber, or a turbine exhaust could serve as the hot gas source.

The invention will be further described with reference to the accompanying drawings wherein.

Figure 1:
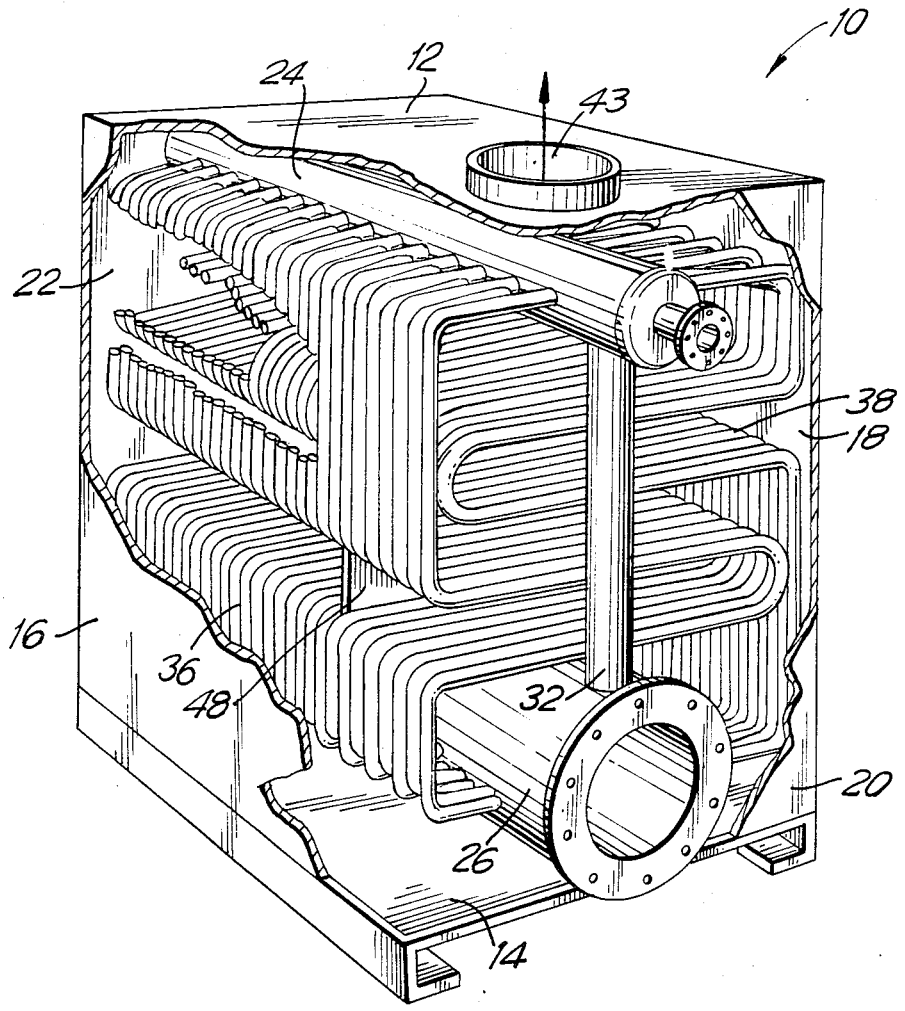
FIG. 1 is a perspective view of a boiler in accordance with the invention, with the housing partly broken away.

Referring now more particularly to the drawings, in FIG. 1 there is shown a housing 10 having a top wall 12, a bottom wall 14, a left side wall 16, a right side wall 18, a front wall 20 and a rear wall 22. A manifold 24 and a jacketed chamber 26 project through the front and rear walls 20 and 22. Means are provided to introduce cold water into the inside of the jacketed chamber 26 at 28 and to remove steam from the manifold at 30, outside the housing.

A pair of downcomers 32 outside the housing front and back connect the lowest part of the manifold 24 with the top of the inside of the jacket 26 so that water in the manifold can rapidly run down for reheating, speeding up the circulation. This also permits the manifold to operate with a shallow level of water which also speeds up production of steam and which permits substantially dry steam to be discharged from the manifold 24.

A plurality of tubes 36, illustratively twenty-three, extend from the left of manifold 24 to the left of jacketed chamber 26 and a similar number of tubes 38 extend from the right of manifold 24 to the right of jacketed chamber 26. Except for the first and last few tubes in each set, for a reason to be described later, the balance of the tubes 36 are all generally similarly bent as are the tubes 38.

Each tube has a vertical component and tubes 38 have two horizontal components, i.e. one run to the left side of the boiler, or actually to the tubes 36, and then a return run. The bends in tubes 38 are not identical to those of tubes 36 but rather complementary so that together they form a series of vertically superposed chambers 40*a*, 40*b*, 40*c*, 40*d* and 40*e*, optionally decreasing in volume from bottom to top to make up for reduction in volume as the hot gas cools, thereby keeping the gas velocity high and maintaining turbulence which helps heat exchange.

Advantageously, the boiler has five, seven or nine chambers above the jacketed chamber. Combustion gases in chamber 40*a* rise through openings in the space and enter chamber 40*b* traversing it horizontally from back to front. The tube bends similarly cause the gases to traverse successive chambers until they reach the topmost chamber 40*e* where they exit through an opening 43 in the top 12.

Figure 4:
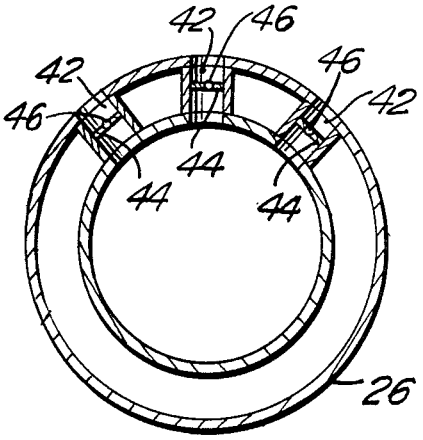
FIG. 4 is a section on line 4—4 of FIG. 3.

The gases flow from 40*a* to 40*b* through openings 42 provided in the jacketed chamber, as shown in FIG. 4. The openings 42 are provided with butterfly dampers 44 whose angle may be adjusted by rotation about axis 46 through a lever system (not shown) so as to be manipulable from outside the housing. In this manner, the effective cross-section of each opening 42 can be adjusted to maintain a predetermined back pressure at the entrance to the jacketed chamber.

For improved heat exchange, in addition to the tortuous gas flow so far defined, a more complex flow is possible. Thus rectangular baffles 48 having the shape shown in FIG. 1 may be provided, extending from adjacent one side wall toward but short of the other. They are just high enough to span a chamber being held in position by their fit between the troughs formed by adjacent tubes. They are inserted by simple sliding and may be removed, or slid more or less into their chambers, either manually or automatically (not shown), as desired.

If more than one baffle 48 is present in a given chamber they must alternately extend from opposite sides. Thus while the combustion gas is moving from rear to front in chamber 40*b* the gas stream must move from side to side to get around the baffles.

Figure 2:
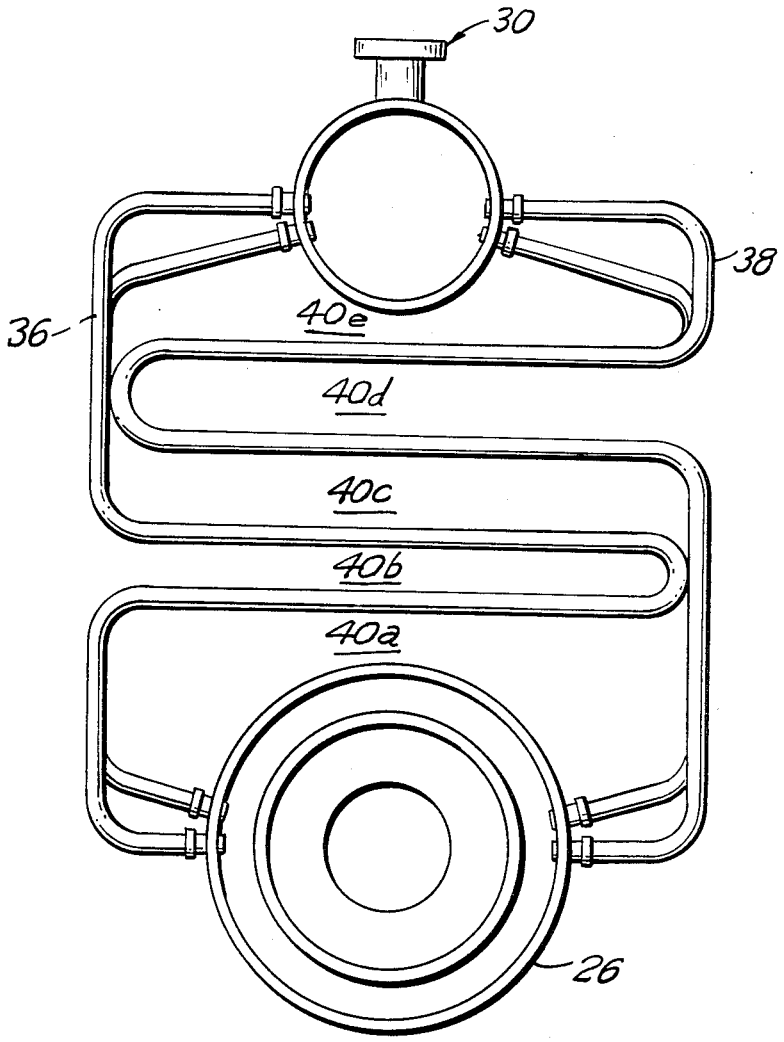
FIG. 2 is a vertical section through the center of FIG. 1, showing the jacketed chamber, manifold and connecting tubes.

In FIGS. 1 and 2 it can be seen that the connections between the tubes and manifold 24 are not in a straight line but rather are staggered. However, all the tubes join the manifold at or below the manifold's horizontal center line and each tube in going from jacketed chamber 26 to manifold 24 has lengths which rise or are horizontal but has no lengths which go downwardly, thereby avoiding entrapment of gas.

The baffles can serve a further purpose, viz. maintaining efficient utilization of fuel notwithstanding fluctuating fuel feed rates as a consequence of fluctuation in steam demand. Specifically, one monitors the oxygen content of the hot gas exiting the boiler which otherwise will change as feed and demand vary. However, the position of the baffle or baffles is adjusted to maintain this oxygen content substantially constant, e.g. as demand goes down the oxygen content will go up, so the baffle positions will be adjusted to give more baffling and thereby restore the oxygen level to the predetemined value.

Figure 3:
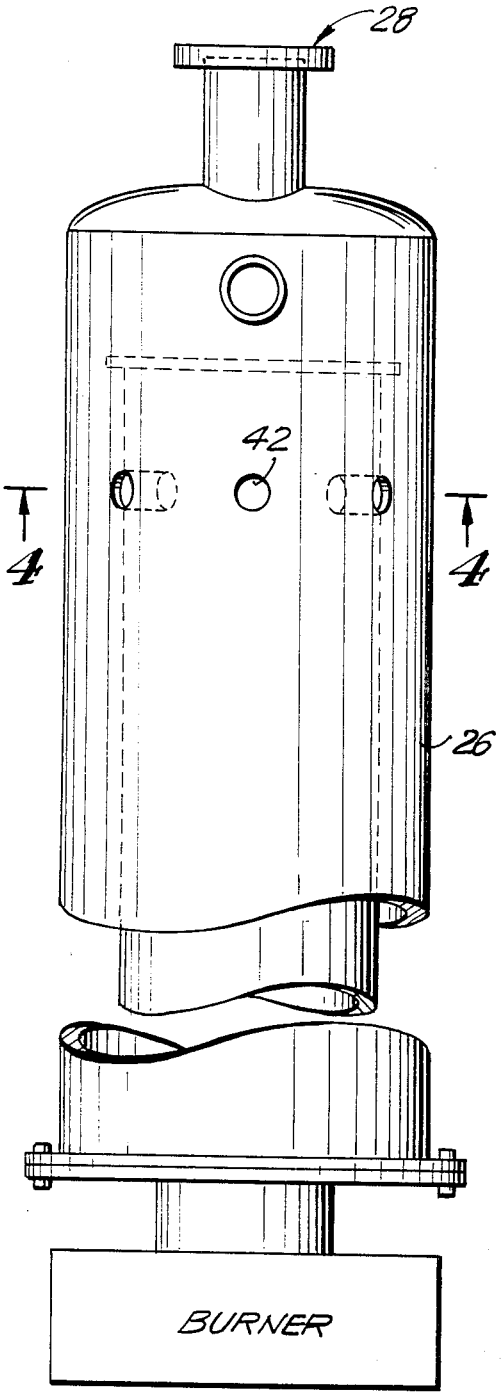
FIG. 3 is a plan view of the jacketed chamber plus burner.

The boiler works especially well in conjunction with the oil or gas burner 60 shown in FIG. 3.

Figure 5:
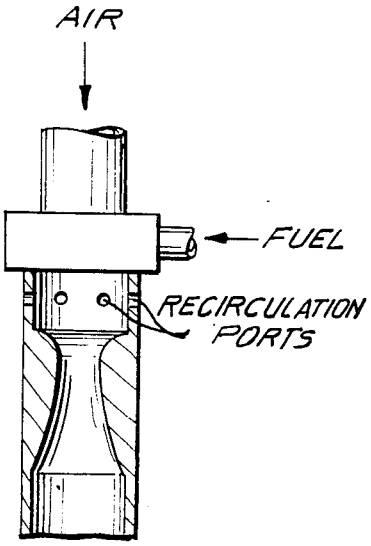
FIG. 5 is a schematic sectional view of a venturi nozzle for feeding gas to be burned.

The burner nozzle for supply of gas to be burned advantageously has a venturi throat as shown in FIG. 5.

It will be understood that the specification and examples are illustrative but not limitative of the present invention and that other embodiments within the spirit and scope of the invention will suggest themselves to those skilled in the art.

What is claimed:

1. In a boiler comprising a housing having a top provided with a gas outlet, bottom, left and right sides and a front and back, the housing containing a manifold substantially parallel to the top, bottom and side walls, two sets of tubes, each set comprising a plurality of tubes, one set joining the upper manifold on the left and the other set joining the upper manifold on the right, the tubes of each set rising upwardly along their respective side wall, crossing the housing to the opposite side wall, rising adjacent the opposite side wall, re-crossing the housing to their respective side wall, rising therealong and eventually joining the upper manifold, the horizontal runs of the tubes of one set being vertically offset relative to the horizontal runs of the tubes of the other set so as to form a plurality of superposed chambers above the jacketed chamber, individual tubes of the sets being differently bent so as to form access openings from each chamber to the chambers above and below, the openings from chamber being offset so as to require a gas flowing through said chambers to traverse one chamber form front to back and the next chamber from back to front, means for introducing water into the boiler and for withdrawing steam from the manifold, and means for introducing a hot gas into the lowermost of the superposed chambers, the hot gas rising successively through the chambers which it successively and alternately traverses from front to back and then from back to front until it exits from the uppermost chamber through the gas outlet in the top, water flowing through the tubes being heated by the hot gas, the improvement which comprises a jacketed chamber adjacent the bottom of the housing and substantially parallel to the manifold, the lower ends of the two sets of tubes communicating with the jacket, the jacketed chamber being provided with at least one opening for passage of a hot gas into the next of the superposed chambers, the means for introducing water into the boiler introducing such water into the interior of the jacket from which it flows upwardly through the tubes, and a fuel burner positioned at least partly inside the housing so as to discharge hot combustion gas into the jacketed chamber, whereby upon burning fuel within said jacketed chamber the hot combustion gas rises through the chambers heating the water in the tubes.

2. A boiler according to claim 1, wherein the jacketed chamber is a substantially horizontal double walled cylinder.

3. A boiler according to claim 1, wherein the jacket on its inside comprises unlined metal.

4. A boiler according to claim 1, wherein all the tubes join the manifold at or below the manifold's horizontal center line.

5. A boiler according to claim 4, wherein each tube in going from jacketed chamber to manifold has lengths which rise or are horizontal but has no lengths which go downwardly, thereby avoiding entrapment of gas.

6. A boiler according to claim 1, wherein the boiler has five, seven or nine chambers.

7. A boiler according to claim 1, wherein successive chambers above the jacketed chamber and from bottom to top are reduced in volume to make up for the reduction in volume as the hot gas cools, thereby keeping the gas velocity high and maintaining turbulence which helps heat exchange.

8. A boiler according to claim 1, including a plurality of baffles in a plurality of chambers above the jacketed chamber, the baffles being angled within their chambers so that the hot gas hits them at an angle less than 90° so as to be deflected thereby in the direction of its advance, thereby avoiding hot spots.

9. A boiler according to claim 1, including means for adjusting the effective cross-section of the opening in the jacketed chamber leading to the next of the superposed chambers, whereby the back pressure at the entrance to the jacketed chamber can be set at a predetermined value.

10. A combination according to claim 1, wherein the burner is a gas or oil fired burner including a nozzle and a venturi passage for recirculation of combustion gas past the nozzle to effect complete combustion.

11. A boiler according to claim 1, including at least one baffle within at least one of the chambers above the jacketed chamber and extending from top to bottom and from one of the sides toward but terminating short of the other, whereby hot gas traversing that chamber from front to back is additionally forced to flow laterally to get around said baffle.

12. A boiler according to claim 11, wherein the baffle is angled within its chamber so that the hot gas hits it at an angle less than 90° so as to be deflected thereby in the direction of its advance, thereby avoiding hot spots.

* * * * *

UNITED STATES PATENT AND TRADEMARK OFFICE

CERTIFICATE OF CORRECTION

PATENT NO. : 4,612,879

DATED : September 23, 1986

INVENTOR(S) : George Cooke

It is certified that error appears in the above-identified patent and that said Letters Patent are hereby corrected as shown below:

| | |
|---|---|
| Col. 4, line 45 | After "chamber" insert --to chamber-- |
| Col. 4, line 47 | Delete "form" and substitute --from-- |

Signed and Sealed this

Third Day of February, 1987

*Attest:*

DONALD J. QUIGG

*Attesting Officer*

*Commissioner of Patents and Trademarks*